United States Patent [19]

Lombard

[11] Patent Number: 4,635,679

[45] Date of Patent: Jan. 13, 1987

[54] SINGLE ROCKER DEVICE FOR ACTUATING TWO VALVES

[75] Inventor: Roger Lombard, Noisy-Le-Sec, France

[73] Assignees: Automobiles Peugeot, Paris; Automobiles Citroen, Neuilly-Sur-Seine, both of France

[21] Appl. No.: 798,636

[22] Filed: Nov. 15, 1985

[30] Foreign Application Priority Data

Nov. 19, 1984 [FR] France ..... 84 17615

[51] Int. Cl.[4] ..... F01L 1/26

[52] U.S. Cl. ..... 137/601; 123/90.4; 123/90.22; 123/90.27

[58] Field of Search ..... 123/90.4, 90.22, 90.23, 123/90.39, 90.44, 90.27; 137/601

[56] References Cited

U.S. PATENT DOCUMENTS

| | | | |
|---|---|---|---|
| 1,693,832 | 12/1928 | Vincent | 123/90.4 |
| 2,024,334 | 12/1935 | Caminez | 123/90.4 |
| 2,610,617 | 9/1952 | Pielstick | 123/90.4 |
| 2,963,010 | 12/1960 | Payne | 123/90.39 |
| 3,418,984 | 12/1968 | Skatsche | 123/90.39 |
| 3,428,032 | 2/1969 | Rudert | 123/90.4 |
| 3,967,601 | 7/1976 | Heberle | 123/90.39 |
| 4,561,391 | 12/1985 | Simko | 123/90.4 |

FOREIGN PATENT DOCUMENTS

| | | |
|---|---|---|
| 1390661 | 1/1965 | France . |
| 2129059 | 10/1972 | France . |

*Primary Examiner*—Ira S. Lazarus

*Attorney, Agent, or Firm*—Burns, Doane, Swecker & Mathis

[57] ABSTRACT

The invention has for purpose to provide a simple and light device for actuating, with equal, and even zero, operating clearances, two valves having a rod associated with a single rocker. This device comprises a rocker (1) which is pivotally mounted on a shaft (2) and includes two arms (19, 20) terminating in bosses (21, 22) respectively bearing against the end (25, 26) of associated valve rods. The rocker (1) is slidably mounted on its shaft (2) and, in the region of each boss, one of the contacting surfaces of the boss or the end of the rod is curved in the shape of a substantially spherical dome, the other surface being planar or cylindrical, the two planar or cylindrical surfaces being inclined and disposed roughly symmetrically relative to a plane (P—P) perpendicular to the shaft of the rocker.

12 Claims, 4 Drawing Figures

FIG.3
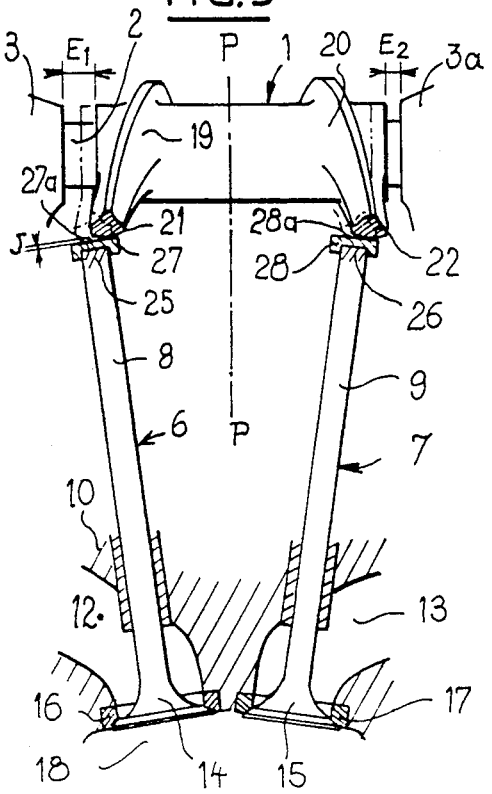
FIG.1
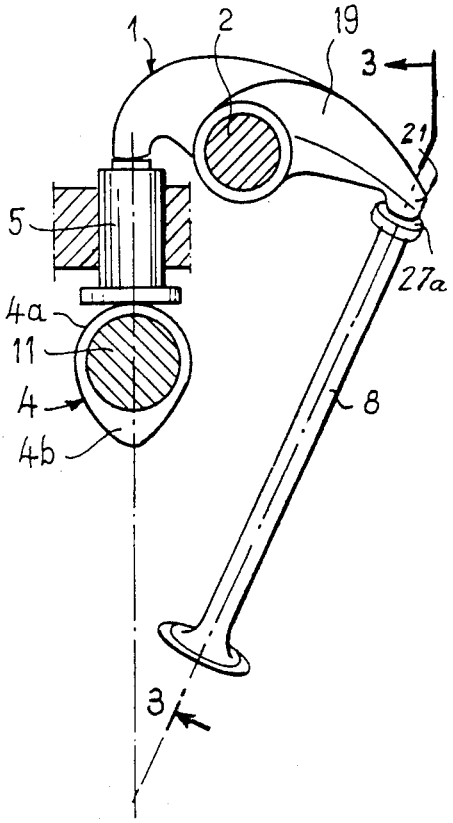
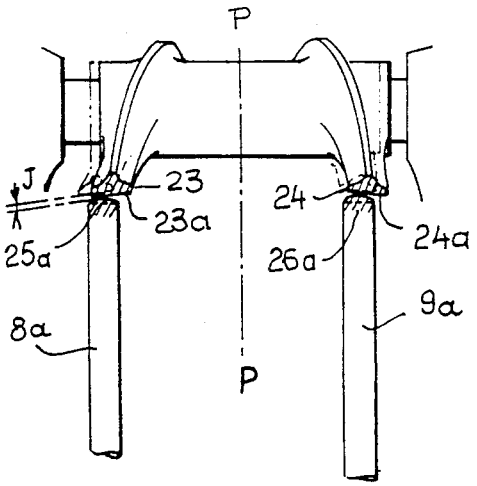
FIG.4
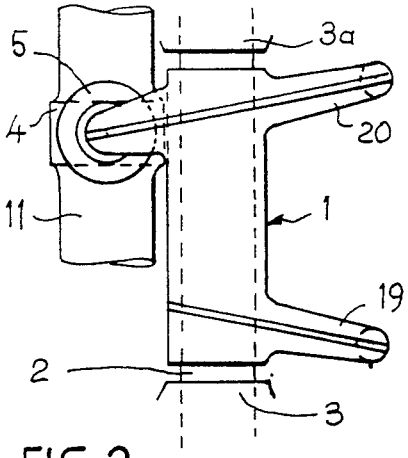
FIG.2

SINGLE ROCKER DEVICE FOR ACTUATING TWO VALVES

The invention relates to devices employed in certain internal combustion engines for simultaneously actuating two valves having a rod by means of a single rocker.

In such an arrangement, as the two rods are parallel to each other or only slightly inclined relative to each other, the rocker pivots about an axis rougly orthogonal to the two rods and bears against the end face of each thereof by two bosses located respectively at the end of two juxtaposed arms of the rocker. In order to ensure that the bearing of each boss on the associated rod occurs suitably when the rocker pivots, said end face being flat and perpendicular to the axis of the rod, the cooperating face of the boss is curved and has the general shape of a spherical dome.

Each valve is urged or biased toward the corresponding boss by a spring which tends to apply the valve head against a seat defining an inlet or exhaust conduit, and the rocker pivots under the action of a rotary cam whose contour, provided with a circular portion and a lobe, acts on the rocker directly or through a sliding pushrod.

When the rocker is in contact with the lobe of the cam, its two bosses urge the two rods in opposition to the action of the springs and move the two valves away from their respective seats and therefore open the corresponding conduits. When the rocker or the pushrod cooperates with the circular portion of the cam, each valve bears against its seat and closes the corresponding conduit. In order to make quite sure that each valve is in contact with its seat, there is most often provided an operating clearance which is generally adjusted by an adapted screwthread means in the region of each of the two bosses, which is relatively costly, consumes space and has an inertia having an adverse effect on the operation of the engine. By way of a modification, a device for taking up clearance is provided between the rocker and the cam or in the région of the shaft of the rocker, but in this case, owing to manufacturing tolerances of the rocker, the valves and the parts which support them, unless a costly matching of the parts or an adjustment by means of a shim is employed, the operating clearance is only eliminated for one of the parts. Consequently, there is a loss in the rising travel and an increase in noise and wear of the other valve.

An object of the invention is to provide, by simple and light means, a device capable of actuating with equal, or even zero, operating clearances two valves having a rod associated with a single rocker.

The invention therefore provides a device for actuating two valves having a rod, comprising a rocker which is mounted to be pivotable about a shaft and comprises two arms terminating in bosses which respectively bear against the end of the associated valve rods, wherein the rocker is slidably mounted on its pivot shaft and, in the region of each boss, one of the two surfaces in contact of the boss or the end of the rod, is curved in the shape of a substantially spherical dome, the other surface being planar or cylindrical, the two planar or cylindrical surfaces being inclined and roughly symmetrically disposed relative to a plane perpendicular to the pivot shaft of the rocker.

According to other advantageous features of the invention:

as the rods of the valves are symmetrically inclined relative to a plane perpendicular to the pivot shaft of the rocker and their end surface (or that of an added end member) is perpendicular to their axis, the surface of the boss is curved in the shape of a substantially spherical dome;

as the rods of the valves are roughly parallel to each other and orthogonal to the pivot shaft of the rocker, their end surface is curved in the shape of a substantially spherical dome and the respective surfaces of the two bosses are planar or cylindrical;

the device is provided with a single automatic means of adjusting or taking up the operating clearance, for example associated with a pushrod interposed between the rocker and a rotary actuating cam.

Two embodiments of an actuating device according to the invention will be described hereinafter with reference to the accompanying drawings in which:

FIG. 1 is a simplified view of the device according to a first embodiment, with partial sectional views in planes perpendicular to the pivot shaft of the rockers;

FIG. 2 is a top plan view thereof;

FIG. 3 is a sectional view taken on line 3—3 of FIG. 1, and

FIG. 4 is a view similar to FIG. 3 in respect of a second embodiment of the invention.

The Figures show a rocker 1 which is pivotally mounted on a pivot shaft 2 carried by two bearings 3, **3*a* and cooperates on one side with a cam 4 through a pushrod 5 and on the other side with two valves 6, 7 having a rod 8, 9. The assembly is carried in the conventional manner by a cylinder head 10 of an internal combustion engine, the cam 4 being rigid with a camshaft 11 parallel to the shaft 2 and the pushrod 5 sliding in a guide perpendicular to the shaft 11. The two rods 8, 9 which are roughly orthogonal to the shaft 2 slide in the cylinder head 10, and each of the valves is capable of closing one of two inlet or exhaust conduits 12, 13 by their enlarged head 14, 15 bearing against a seat 16, 17 through which the corresponding conduit communicates with a combustion chamber 18**.

Conventionally, springs (not shown) respectively exert on each of the valves a permanent axial force tending to place them in their closing position, which they reach when the pushrod 5 cooperates with a circular portion **4*a* of the cam, while they move away from their seats and open the associated conduits 12, 13 when the pushrod 5 cooperates with a lobe 4*b*** of the cam.

The rocker 1 is pivotally mounted on the shaft 2 and a notable space E1, E2 separates it from each bearing 3, **3*a* in the axial direction. It has two arms 19, 20 at the end of each of which is formed a boss 21, 22 (FIG. 3) or 23, 24 (FIG. 4) cooperating with the end face 25*a*, 26*a* of each of the rods (FIG. 4) or with a face 27*a*, 28*a* of an end member 27, 28 added to the end 25, 26 of the corresponding rod (FIG. 3**).

According to the embodiment shown in FIG. 3 in which the valves 6 and 7 are slightly inclined relative to a plane P—P perpendicular to the shaft 2, the faces **27*a*, 28*a*** of the end members are flat and each perpendicular to the axis of the corresponding rod and the respective corresponding faces of the two bosses are curved, for example in the shape of a spherical dome.

In the embodiment shown in FIG. 4, in which the rods **8*a*, 9*a* of the valves are roughly parallel to each other and orthogonal to the shaft 2, the end face 25*a*, 26*a* of the rods is curved in the shape of a spherical dome or roughly spherical, and the bosses 23, 24 cooperate with these faces respectively by two planar faces 23***a*, 24*a* which are symmetrically inclined relative to the aforementioned plane P—P. Instead of being planar, these two faces 23*a*, 24*a* may, in a modification, be portions of a cylinder having their respective generatrices symmetrical relative to the plane P—P.

The pushrod 5 includes a known device (not shown), for taking up clearance and tending to lengthen when it is not subjected to a notable axial force, in particular when an operating clearance appears between the rocker and the cooperating parts when the valves bear against their respective seats. By way of a modification, instead of being associated with the pushrod 5, the clearance taking up device may be interposed in the known manner between the shaft 2 and the cylinder head 10.

Owing to the symmetrical inclination of the faces 27*a*, 28*a* or 23*a*, 24*a* and owing to the slidable mounting of the rocker 1 on its shaft 2, the clearance is taken up for both the two valves, notwithstanding inevitable imperfections in the manufacture of the latter, of the rocker and of the parts supporting them. Indeed, if an operating clearance J appears in the region of one, 21, 23, of the bosses (the rocker shown in dot-dash line in FIGS. 3 and 4), the thrust exerted by the other boss 22, 24 of the associated end face 28*a*, 26*a* produces, owing to the inclination of one of the two cooperating faces relative to the shaft 2, a sliding of the rocker on this shaft until the boss 21, 23 comes into contact with the associated face 27*a*, 28*a*. A self-centering of the rocker relative to the valves is then achieved.

By way of a modification, the pushrod does not include a clearance taking up device, but cooperates with the rocker through conventional clearance adjusting means. This single adjusting means is sufficient to ensure equal operating clearances for the two valves, since if these two clearances differed, the boss corresponding to the smaller of these clearances would come into contact with the associated rod before the other boss, and would produce, as indicated above, the self-centering of the rocker by a sliding on its shaft until the other boss reaches the cooperating face. This arrangement has less inertia and is cheaper than those which include an adjusting means in the region of each of the two bosses, and it ensures equality of the two operating clearances, even after a possible different wear of the cooperating faces, since the correction by a self-centering of the rocker occurs permanently during the operation of the engine.

What is claimed is:

1. A device in combination with for actuating two valves including valve rods having ends, said device comprising a shaft, a rocker pivotally mounted on said shaft and comprising two arms, a boss on each arm cooperative with a respective one of said ends of said rods, each boss and respective rod end defining two cooperative contacting surfaces, one of which cooperative contacting surfaces is curved in the shape of a substantially spherical dome while the other of said cooperative contacting surfaces is planar, the two planar surfaces being inclined and disposed substantially symmetrically relative to a plane perpendicular to said shaft.

2. A device according to claim 1, wherein said valve rods are inclined substantially symmetrically relative to said plane and said planar contact surfaces are defined by said ends of said rods and are perpendicular to longitudinal axes of said rods and said bosses define said substantially spherical dome-shaped surfaces.

3. A device according to claim 1, wherein said valve rods are inclined substantially symmetrically relative to said plane and said cylindrical contact surfaces are defined by said ends of said rods and are perpendicular to longitudinal axes of said rods and said bosses define said substantially spherical dome-shaped surfaces.

4. A device according to claim 1, wherein said rods are substantially parallel to each other and orthogonal to said shaft and said ends of said rods define said substantially spherical dome-shaped surfaces and said bosses define said planar surfaces.

5. A device according to claim 1, wherein said rods are substantially parallel to each other and orthogonal to said shaft and said ends of said rods define said substantially spherical dome-shaped surfaces and said bosses define said cylindrical surfaces.

6. A device according to claim 1, further comprising end members carried by said rods.

7. A device according to claim 1, comprising a single means for automatically adjusting or taking up operating clearance.

8. A device according to claim 7, wherein said single means is associated with a pushrod interposed between the rocker and a rotary actuating cam.

9. A device in combination with for actuating two valves including valve rods having ends, said device comprising a shaft, a rocker pivotally mounted on said shaft and comprising two arms, a boss on each arm cooperative with a respective one of said ends of said rods, each boss and respective rod end defining two cooperative contacting surfaces, one of which cooperative contacting surfaces is curved in the shape of a substantially spherical dome while the other of said cooperative contacting surfaces is cylindrical, the two cylindrical surfaces being inclined and disposed substantially symmetrically relative to a plane perpendicular to said shaft.

10. A device according to claim 9, further comprising end members carried by said rods.

11. A device according to claim 9, comprising a single means for automatically adjusting or taking up operating clearance.

12. A device according to claim 11, wherein said single means is associated with a pushrod interposed between the rocker and a rotary actuating cam.

* * * * *